US007140135B2

(12) United States Patent
Irvine et al.

(10) Patent No.: US 7,140,135 B2
(45) Date of Patent: Nov. 28, 2006

(54) FLAG LABEL

(75) Inventors: Alexander J. Irvine, Neenah, WI (US); Robert C. Zeltlow, Neenah, WI (US); David C. Cook, Mukwonago, WI (US); Ronald G. Hagen, Larsen, WI (US)

(73) Assignee: Wisconsin Label Corporation, Algoma, WI (US)

( * ) Notice: Subject to any disclaimer, the term of this patent is extended or adjusted under 35 U.S.C. 154(b) by 59 days.

(21) Appl. No.: 10/427,227

(22) Filed: May 1, 2003

(65) Prior Publication Data

US 2004/0217022 A1 Nov. 4, 2004

(51) Int. Cl.
*G09F 3/00* (2006.01)
*B42D 15/00* (2006.01)

(52) U.S. Cl. ..... 40/638; 40/674; 40/675; 283/81; 283/94; 428/40.1

(58) Field of Classification Search ..... 206/216, 206/459.5, 831; 40/310, 312, 638, 674, 675; 283/81, 51, 74, 94, 100, 101; 428/40.1, 41.7, 428/41.8, 42.2, 201, 202, 203
See application file for complete search history.

(56) References Cited

U.S. PATENT DOCUMENTS 4,060,168 A * 11/1977 Romagnoli ..... 206/216
4,264,657 A * 4/1981 Tollette ..... 428/202
5,207,458 A * 5/1993 Treichel et al. ..... 40/310
5,217,307 A * 6/1993 McClintock ..... 383/81
5,362,561 A * 11/1994 Lower ..... 40/310
5,960,947 A * 10/1999 Dimelis et al. ..... 206/216
5,975,582 A * 11/1999 Treleaven ..... 283/81
6,035,568 A * 3/2000 Grosskopf et al. ..... 40/638
6,051,311 A * 4/2000 Osaka ..... 428/40.1
6,254,137 B1 * 7/2001 Baum et al. ..... 283/81
6,617,000 B1 * 9/2003 Denny et al. ..... 428/40.1
6,756,095 B1 * 6/2004 Sandt et al. ..... 428/40.1

* cited by examiner

*Primary Examiner*—Luan K. Bui
(74) *Attorney, Agent, or Firm*—Reinhart Boerner Van Deuren s.c.

(57) ABSTRACT

A flag label for attaching to a product has adhesive faced transparent over-laminate and under-laminate layers on opposite sides of a printed layer. This assembly is releasably mounted on a release liner prior to use. The over-laminate defines an pressure sensitive adhesive backed tab portion demarcated by a tear line of perforations from a body portion of the label, which has pressure sensitive adhesive areas on its rear surface. The tab portion extends from the body portion and a portion of the body portion is unsupported by the product when attached.

12 Claims, 3 Drawing Sheets

FLAG LABEL

CROSS-REFERENCE TO RELATED APPLICATION

Not Applicable.

STATEMENT OF GOVERNMENT SPONSORED DEVELOPMENT

Not applicable.

FIELD OF THE INVENTION

This invention relates to labels for attachment to products, and in particular to labels used for promotional purposes that are easily removed, extend the display area of the product and are capable of being automatically applied to products.

BACKGROUND OF THE INVENTION

Point of purchase promotional items can be an effective marketing tool for the sale of consumer products. One common technique is to attach the promotional items directly to the products being displayed for sale. The promotional items can be adhesive backed labels that are either removable or have tear-away panels. In this way, the labels can be used as coupons that consumers can separate from the product and redeem at purchase. The labels may also bridge between the lid and jar of a product to provide a tamper evident seal, and can also be used as tokens for a promotional game or small entry forms for a promotional give-away.

Conventional labels of this type typically include a base sheet with a back side coated with an adhesive that is not releasable, thus leaving behind either a sticky residue or a partially torn label when removed. They may also be folded into small booklets or include several separate panels that can be torn away from a base sheet. Besides the complexity of manufacturing such labels, they also take up space on the product or its packaging that would otherwise be used for decals or printed product information, such as the trade name of the product and product content information. If the space for the promotional labels is not reserved, they would simply be attached on top of the other product information, thereby obstructing the consumer's view to the product advertisement or information, at least while the promotional label is attached.

One way to avoid this is strategic placement of the promotional label, such as at a corner or edge of the product. However, it may not always be possible to avoid interfering with the product labeling and if the promotional labels are attached after the product is packaged, perhaps by the retailer, the product manufacturer may be unable to ensure proper placement of the promotional labels.

Another way is to use a neck hanger label, which is easily removed and extends the printable area of the packaging without obscuring information on the container. Such labels are effective to call a consumer's attention to a product, to put a selling message in front of the customer, even if not used as a coupon. However, neck hangers are not easily applied automatically and can create somewhat of a dishevelled appearance of the product.

Thus, an improved product label is needed which is capable of automatic application, able to be used so as to extend the printable area of the packaging, is securely affixable to the product container and able to be used as a tamper evident seal.

BRIEF SUMMARY OF THE INVENTION

A label of the invention has a body portion and a tab portion extending from an edge of the body portion, with a layer of pressure sensitive adhesive on a rear side of the tab portion and one or more pressure sensitive adhesive areas bordered by non-adhesive areas on the rear side of the body portion. Printed indicia on the body portion are visible from a front side of the label. The label can be adhered to a substrate by the layer of pressure sensitive adhesive on the rear side of the tab portion and by the pressure sensitive adhesive area on the rear side of the body portion. Thereby, the label is capable of automatic application, is able to be used so as to extend the printable area of the packaging, is securely affixable to the product container and is able to be used as a tamper evident seal.

In one aspect of the invention, the body portion includes a laminate layer from which the tab portion is formed. Thereby, a commonly available pressure sensitive adhesive backed overlaminate layer can be used to provide a layer of the body portion and the adhesive backed tab portion. Preferably, this is the top layer of the label.

In another aspect, the body portion includes a printed layer which is adhered to the rear side of the over-laminate layer and the over-laminate layer is transparent. The printed indicia are printed on the printed layer and visible through the laminate layer.

In another aspect, a second, or under-laminate, laminate layer is adhered to the rear side of the printed layer and the areas of pressure sensitive adhesive on the rear of the body portion are provided on the rear surface of the under-laminate layer. The under-laminate layer helps stiffen and strengthen the label so that it will endure being unsupported by the product in the unadhered areas of the body portion, and also provides an impervious and stable surface to which to apply the adhesive areas.

In another aspect, the pressure sensitive adhesive of the at least one pressure sensitive adhesive area on the rear of the body portion is a removable pressure sensitive adhesive. In addition, a tear line preferably separates the tab portion from the body portion so that the body portion can be separated from the tab portion and removed from a product container to which it is adhered by the adhesive areas on its back, leaving the tab portion on the product.

In addition, a label of the invention is capable of automatic application by providing a series of labels of the invention on a release liner, the labels being removably adhered to the release liner by the pressure sensitive adhesive on the rear sides of the tab portions of the labels and by the at least one pressure sensitive adhesive areas on the rear sides of the body portions of the labels. The release liner with labels attached can be used in well-known automatic machinery to apply the labels to product packages in a high speed production line.

In a preferred form, the laminate layers are adhesive faced and transparent. These layers include an over-laminate which covers the top of the printed layer and extends beyond to define the tab portion with exposed adhesive on the back, and an under-laminate adhered on its front face to the back of the printed layer and having on its exposed rear face one or more adhesive areas, such as one or more pressure sensitive adhesive beads, bordered by non-adhesive areas.

The body portion can be any shape, however, it is preferably substantially rectangular (like conventional coupons). Depending on the shape of the product and the desired attachment location, the label can be formed so that the tab extends from an end or side of the body portion. In addition, the label can extend beyond an edge or side of the product container to increase the printable area of the package.

Another aspect of the invention provides a tamper-evident product package including the packaging and one or more flag labels. The packaging includes a container having an opening and a closure for closing the opening in the container. The label is attached to the packaging so that the tab is adhered to either the closure or the container and the adhesive area on the under-laminate is adhered to the other component.

In this way, movement or separation of the closure with respect to the container is made apparent by the label tearing along the perforations. The body portion can be separated from the tab portion and the product and used as a coupon or for another marketing purpose.

The advantages of the invention will appear from the following description. In this description, reference is made to the accompanying drawings which form a part hereof and in which there is shown by way of illustration preferred embodiments of the invention. These embodiments do not represent the full scope of the invention. Thus, the claims should be looked to in order to ascertain the scope of the invention.

DETAILED DESCRIPTION OF THE PREFERRED EMBODIMENTS

Figure 1:
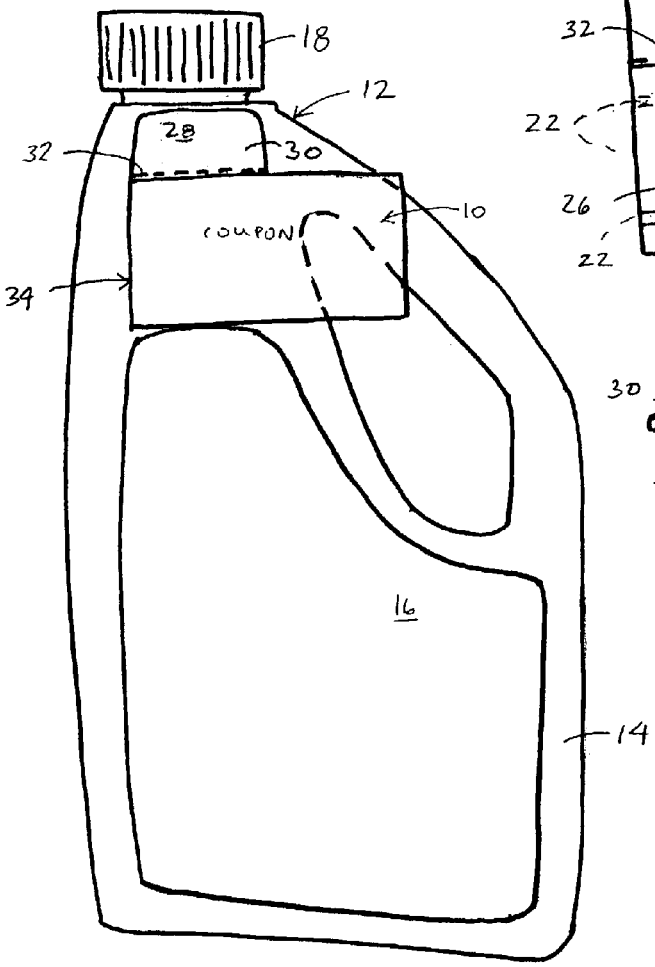
FIG. 1 is a front view of a product package having a flag label according to the present invention.

FIG. 1 shows a flag label 10 of the present invention attached to a product package 12 in one preferred configuration. As can be seen, the flag label 10 is adhered to a container 14 of the package near its top adjacent to the closure cap 18. Only one end (the left end as shown in FIG. 1) of the flag label 10 is adhered to the package. The opposite end extends beyond the edge of the package, across the handle opening so as to span otherwise open, unprintable space, and preferably is adhered to the handle on the other side of the handle opening.

Figure 2:
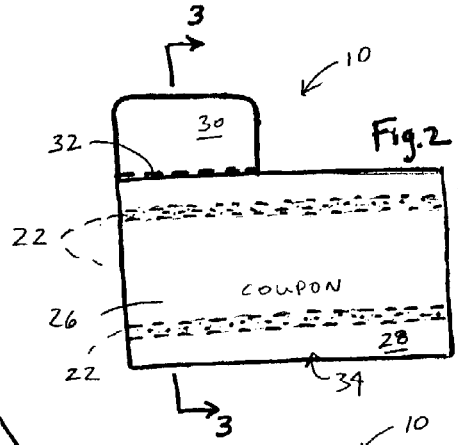
FIG. 2 is a top plan view of a flag label with a tab portion extending perpendicularly from one side of a tear-away body portion of the label.
Figure 3:
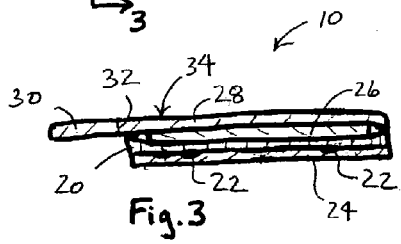
FIG. 3 is a cross-sectional view through line 3—3 of FIG. 2 showing the layers of the flag label.

Referring to FIGS. 2 and 3, the flag label 10 includes a transparent under-laminate 20 having at its rear or underside one or more (preferably two as illustrated) adhesive areas provided by thin beads 22 of a suitable pressure sensitive adhesive. The areas of the rear side of the under-laminate which border the adhesive areas are free of adhesive and are non-tacky. Prior to application to a product, the under-laminate 20 is adhered by the adhesive beads 22 to a release liner 24 having an upper release surface. The under-laminate 20 has a permanent pressure sensitive adhesive front or upper face that adheres to a printed layer 26, preferably made of paper or other printable material, and is preferably rectangular and sized approximately the same as the under-laminate 20. The printed layer 26 preferably contains indicia defining a coupon, game piece or other promotional item. The transparent over-laminate 28 has a permanent pressure sensitive adhesive bottom face that adheres to the printed layer 26 so as to sandwich the printed layer 26 between the two laminate layers 20 and 28. The over-laminate 28 also defines a tab portion 30 extending out from one of the long sides of body portion 34, which extends beyond the body portion 34, and therefore beyond the printed layer 26 and the under-laminate layer 20. The adhesive on the back side of the tab 30 can be used to adhere the label to the release liner prior to application to a product, and to the product after application. The over-laminate 28 is perforated across its width adjacent the printed layer 26, at the junction between the tab portion 30 and the body portion 31. This tear line 32, made up of a line of spaced perforations or cuts, defines the boundary between the tab portion 30 and body portion 34 of-the flag label 10, including the printed layer 26, the under-laminate 20 and most of the over-laminate 28, and is generally parallel to the adhesive beads 22. The portion 34 can preferably be separated from the tab portion 30 along the tear line 32 during use, leaving the tab 30 on the product and the remainder of the label in the user's hand.

In a preferred form, the over-laminate 28 is made of a transparent film of polystyrene coated on its rear side with a pressure sensitive adhesive and supplied on a release liner. The printed layer is made of any suitable printable paper, film, foil or other material. The under-laminate 20 is preferably a transparent self-wound polypropylene film, backed with pressure sensitive adhesive. The adhesive beads 22 are continuous beads of hot melt, pressure sensitive adhesive, which is removable from the release liner and helps adhere the label to a product package, but preferably allows the label to be removed from the product package to which it is ultimately applied. The adhesive area could be any pattern of printed or extruded adhesive. The release liner 24 is any suitable release liner material, preferably providing a relatively tight release of the label 10. Other materials, could, of course be used.

Figure 4:
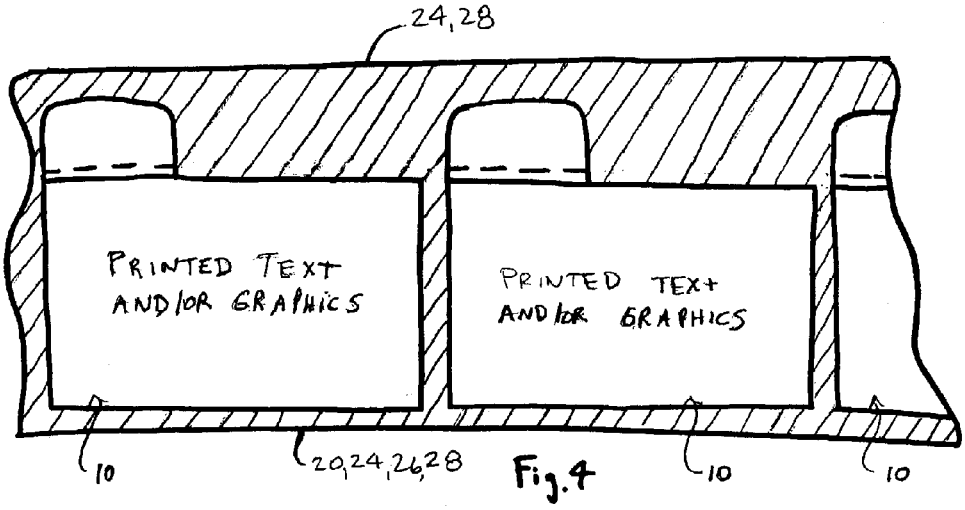
FIG. 4 is a plan view showing a series of flag labels of the invention on a release liner after being die cut and with the waste matrix stripped.

With reference to FIG. 4, multiple flag labels 10 can be manufactured in a continuous line process. Specifically, a reel of the paper stock, printed with a series of graphics and text defining a series of the promotional items spaced apart at prescribed intervals, is unwound and brought together with an unwound section of the self-wound under-laminate so that its adhesive face adheres to the paper, covering the back side of the paper web. One or more continuous beads of adhesive are applied to the release face of the release liner where it contacts the opposite (non-adhesive) face of the under-laminate and the assembly is brought in contact with the adhesive beads-on the release liner with the paper facing up, so that the adhesive beads make contact with and adhere to the exposed, non-adhesive face of the under-laminate. A reel of over-laminate backed by a release liner is unwound and the over-laminate is stripped from its release liner and brought in contact with the aforementioned assembly so that the adhesive face of the over-laminate contacts the paper and, at the margins outside of the paper (if any), the under-laminate. Note that the over-laminate and the release liner are wider than the paper and under-laminate. A cutting tool (i.e., a cutting roller) cuts through the over-laminate to the release liner to define the outer perimeter of the labels and to form the line 32 of perforations that separates the tab 30 of the over-laminate layer from the remainder of the label. The over-laminate, paper and under-laminate are cut down to the release liner to define the desired outline of the flag labels, leaving a waste matrix outside of the flag labels that is stripped away from the assembly. The waste matrix is represented by the cross-hatching in FIG. 4. Once the waste matrix is removed, the assembly forms a series of flag labels spaced apart on a continuous sheet of release liner, held on the release liner by the adhesive on the back of the tab 30 and by the adhesive beads 22, and the liner strip with mounted labels is then wound on a reel or fan folded as desired. Alternatively, the release liner can be cut between the flag labels to define separate flag labels each mounted on their own liner backing sheet.

The labels can be automatically applied to products on a high speed production line by well-known automatic machines. The adhesive beads 22 stay with the under-laminate so that the flag labels may be attached to the outside of the product or packaging by the adhesive on the back of the tab 30 and by the beads 22. When removed from the product, the line of perforations 32 is broken, leaving the tab behind on the product, and the adhesive bond between the product and the beads 22 is broken, although it may also be: acceptable to leaves the beads 22 behind on the product as well.

The flag labels are attached to a product or packaging by the adhesive on the back side of the tab 30 and the adhesive areas on the back side of the body portion 34 that contact-the product or packaging when the label is applied. The pressure sensitive adhesive coating on the back of the tab 30 strongly adheres to the product/packaging in a permanent or semi-permanent manner. The adhesive beads 22 provide a lesser bond and preferably release from the under-laminate, or alternatively the product/packaging, when the body portion is removed.

In any event, the flag labels of this embodiment are attached by the over-laminate at only one end, like a flag, so that the body portion extends beyond an edge of the product/packaging, as shown in FIG. 1. The laminated layers are flexible but somewhat rigid making the flag label sufficiently rigid to extend sidewise without collapsing. The flag label thus effectively increases the display area of the product/packaging. This also makes the flag label more eye-catching to the consumer and makes it easier to remove by simply peeling the body portion away from the tab portion along the tear line and off of the product/packaging. Only the small transparent tab portion 30 remains on the product/packaging after the body portion 34 is removed.

Thus, the present invention provides a simple flag label that can be used to easily attach promotional offers to products and displays. The flag label is comprised of common stock polymeric films and paper or other printable liners, and the labels can be assembled and applied using continuous automatic line processes. Moreover, the under-laminate and over-laminate are transparent so as not to cover graphics on the printed layer.

Figure 5:
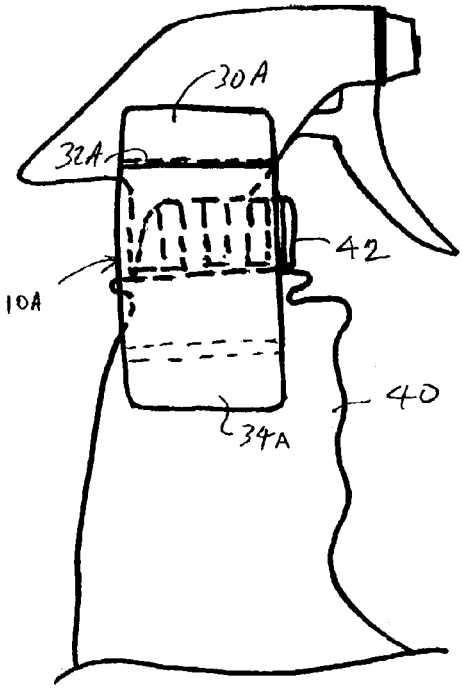
FIGS. 5 and 6 are respective partial front side and back end views of a tamper-evident package having two flag labels of an alternative configuration attached across the opening of the package.
Figure 6:
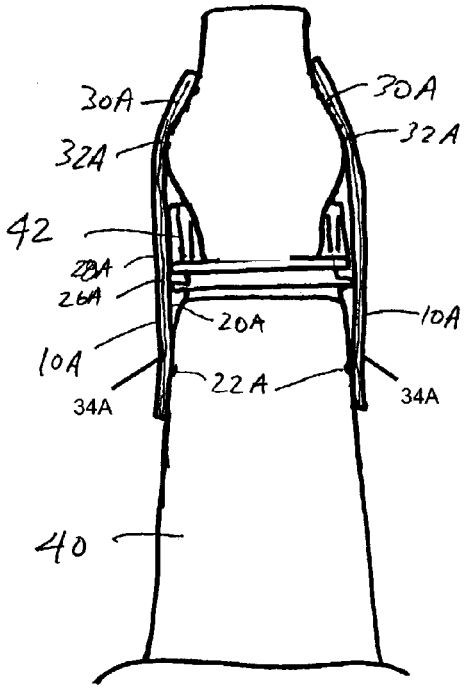
Figure 7:
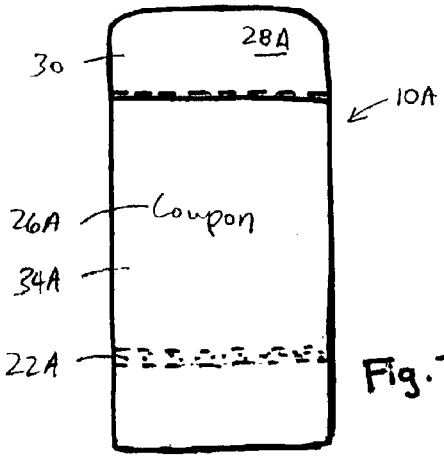
FIG. 7 is a top plan view of an alternative flag label as shown in FIGS. 5 and 6 with a tab portion extending from an end of the body portion.

FIGS. 5–7 illustrate an alternate embodiment of the flag label of the present invention and its use to provide tamper-evident packaging, being applied so as to bridge the closure of a container, with the tab on the closure and the beads of adhesive on the vessel portion of the container. This embodiment of the flag label is similar to that described with a generally rectangular body portion, however, here the tab portion extends along the short end of the body portion, rather than along its long side. The alternate embodiment in these figures illustrates that the flag labels can be of any shape and have a tab portion at any position relative to the body portion.

The flag label of this embodiment is otherwise identical to the first described version and will thus be described generally using similar reference numbers, however with the suffix "A". The flag label 10A has a tab portion 30A and a body portion 34A that can be separated therefrom along a tear line of perforations 32A. The flag label 10A is made of a transparent under-laminate 20A, a paper printed layer 26A and a transparent over-laminate 28A and is preferably manufactured using a continuous line process, as described above with respect to the first embodiment. The laminate layers have adhesive faces that adhere together at the margins (if any) and to the printed layer where they overlap it. One or more adhesive beads 22A run along the bottom surface of the under-laminate across the width of the flag label at a location on the body portion 34A spaced away from the tear line 32A.

The end location of the tab portion in this embodiment allows the flag label to be attached across an opening of the product packaging. That is, for example, the body portion can be adhered via the adhesive bead 22A to the container 40 and the tab portion can be adhered to the closure 42, or to the spray head shown in FIGS. 5 and 6. If desired, there can be two flag labels on opposite sides of the packaging as shown in FIG. 6. With the flag label(s) adhered to the packaging in this manner, if the closure was turned or removed, the flag label(s) would tear along the tear line, thereby providing evidence that the closure was moved and possibly that the product has been tampered with.

While there has been shown and described what are at present considered to be the preferred embodiments of the invention, it will be obvious to those skilled in the art that various changes and modifications can be made to the described device without departing from the scope of the present invention. For example, other materials, such as cellophane tapes, paper, or foil sheets can be used for the various layers of the construction, and the laminate layers need not be transparent. Accordingly, to ascertain the full scope of the invention, reference must be had to the following claims.

What is claimed is:

1. A label for attaching to a product, said label comprising:

a body portion;

a tab portion extending from an edge of the body portion, a tear line separating the tab portion from the body portion, the body portion including a first laminate layer from which the tab portion is formed, a second laminate layer, and a printed layer interposed between said first and second laminate layers;

a layer of a permanent pressure sensitive adhesive on a rear side of the tab portion;

printed indicia on said printed layer visible through said first laminate layer from a front side of the label; and at least one area of a releasable pressure sensitive adhesive on a rear side of the body portion, said adhesive area being bordered by non-adhesive areas of the rear side of the body portion;

wherein the tab portion of the label can be permanently adhered to a substrate by the layer of permanent pressure sensitive adhesive on the rear side of the tab portion and wherein the body portion of the label can be releasably adhered to the substrate by the releasable pressure sensitive adhesive on the rear side of the body portion, permitting the body portion to be separated from the tab portion and removed from the substrate while leaving the tab portion adhered to the substrate.

2. The label of claim 1, wherein the first laminate layer is a top layer of the label.

3. The label of claim 2, wherein the printed layer is adhered to the rear side of the first laminate layer, the first laminate layer is transparent and the printed indicia are printed on the printed layer and visible through the first laminate layer.

4. The label of claim 3, wherein the second laminate layer is adhered to the rear side of the printed layer.

5. The label of claim 4, wherein the at least one pressure sensitive adhesive area is on the rear side of the second laminate layer.

6. The label of claim 1, wherein said pressure sensitive adhesive of said at least one pressure sensitive adhesive area is a continuous bead of a pressure sensitive adhesive.

7. The label of claim 1, further comprising a series of labels of the same construction as the label claimed in claim 1 and a release liner, said series of labels being removably adhered to the release liner by the pressure sensitive adhesive on the rear sides of the tab portions of the labels and by the at least one pressure sensitive adhesive areas on the rear sides of the body portions of the labels.

8. A label for attaching to a product, said label comprising:

a body portion and a tab portion extending from an edge of the body portion, the body portion comprising:

a printed layer visible from a front of the label;

an under-laminate layer having a front side and a rear side, said front side being coated with a pressure sensitive adhesive and adhered to a rear side of the printed layer;

one or more areas of a releasable pressure sensitive adhesive on the rear side of the under-laminate layer, permitting the body portion to be releasably adhered to the product, said adhesive areas being bordered by non-adhesive areas on said rear side; and an over-laminate layer having a rear side coated with a pressure sensitive adhesive, said rear side of said over-laminate layer being adhered to a front side of said printed layer;

wherein said tab portion is formed by an extension of said over-laminate layer which extends beyond edges of said printed layer and said under-laminate layer, said tab portion having a rear side which is coated with a permanent pressure sensitive adhesive, permitting the tab portion to be permanently adhered to the product, and wherein a tear line separates said tab portion from the body portion, permitting the body portion to be separated from the tab portion and removed from the product while leaving the tab portion adhered to the product.

9. The label of claim 8, wherein the over-laminate is transparent.

10. The label of claim 8, wherein at least one or more of the pressure sensitive adhesive on the rear side of the under-laminate layer is an adhesive bead which extends parallel to the tear line.

11. The label of claim 8, wherein the tab portion extends along a portion of a side of the body portion.

12. The label of claim 8, further comprising a series of labels of the construction claimed in claim 8 and a release liner, said series of labels being removably adhered to the release liner by the pressure sensitive adhesive on the rear side of the tabs and by the pressure sensitive adhesive areas on the rear side of the under-laminate layers.

* * * * *

UNITED STATES PATENT AND TRADEMARK OFFICE

CERTIFICATE OF CORRECTION

PATENT NO. : 7,140,135 B2
APPLICATION NO. : 10/427227
DATED : November 28, 2006
INVENTOR(S) : Alexander J. Irvine et al.

It is certified that error appears in the above-identified patent and that said Letters Patent is hereby corrected as shown below:

Title Page, Line (75): "Robert C. Zeltlow" should be --Robert C. Zietlow--

Title Page, (57) Abstract, Line 5: "an pressure sensitive" should be --a pressure sensitive--

Signed and Sealed this

Thirtieth Day of October, 2007

JON W. DUDAS
*Director of the United States Patent and Trademark Office*